US005529806A

United States Patent [19]

Eriksson

[11] Patent Number: 5,529,806

[45] Date of Patent: Jun. 25, 1996

[54] MOVABLY CLAMPED DOCTOR BLADE DEVICE AND PROCESS FOR EVENING THE COATING OF

[75] Inventor: Tore Eriksson, Klässbol, Sweden

[73] Assignee: BTG Kalle Inventing AB, Saffle, Sweden

[21] Appl. No.: 211,078

[22] PCT Filed: Sep. 4, 1992

[86] PCT No.: PCT/SE92/00612

§ 371 Date: Mar. 18, 1994

§ 102(e) Date: Mar. 18, 1994

[87] PCT Pub. No.: WO93/05887

PCT Pub. Date: Apr. 1, 1993

[30] Foreign Application Priority Data

Sep. 25, 1991 [SE] Sweden ..... 9102783-9

[51] Int. Cl.[6] ..... B05D 3/12

[52] U.S. Cl. ..... 427/356; 118/107; 118/126; 118/410

[58] Field of Search ..... 118/126, 107, 118/410; 427/356, 358

[56] References Cited

U.S. PATENT DOCUMENTS 3,358,643 12/1967 Faeber ..... 118/126
4,396,648 8/1983 Holt et al. ..... 118/410
4,899,687 2/1990 Sommer et al. ..... 118/126

FOREIGN PATENT DOCUMENTS 2822682 11/1979 Germany ..... 118/126
2035144 6/1980 United Kingdom ..... 118/126

OTHER PUBLICATIONS

Comparison of Modern Blade Coating Methods, Richard S. Haven, Pulp and Paper International, Apr. 1963.

*Primary Examiner*—Shrive Beck
*Assistant Examiner*—Katherine A. Bareford
*Attorney, Agent, or Firm*—Pravel, Hewitt, Kimball & Krieger

[57] ABSTRACT

An apparatus for blade coating of a travelling web, preferably a paper web, comprising means for supporting and feeding of the web and a doctor blade extending across the web and engaging the web along a first long-side thereof for evening out a coating composition applied to the web and a blade holder carrying the blade along a second long-side, characterized by pressure means arranged to bring, by applying pressure from an outer side of the blade and adjacent to the first long-side, the first long-side of the blade to engagement on the web without imparting substantial bending to the blade as seen in its cross section, said blade being movably clamped in the blade holder; a process for evening the coating of such a traveling web using such an apparatus.

18 Claims, 3 Drawing Sheets

MOVABLY CLAMPED DOCTOR BLADE DEVICE AND PROCESS FOR EVENING THE COATING OF

This patent application claims priority from International Application Number PCT/SE92/00612 with an international filing date of Sep. 4, 1992.

BACKGROUND OF THE INVENTION

The present invention relates to an apparatus for blade coating of a travelling web, preferably a paper web, and the invention also covers a process for providing such coating.

In devices for blade coating of travelling webs, in particular paper webs, the application of the coating composition is controlled by the engagement pressure of the doctor blade against the web, the pressure per unit of surface at the contact area of the blade against the web being substantially determining of the applied quantity of coating composition. Since the pressure per unit of surface is decisive for the applied quantity it is thus essential that the engagement surface of the blade is parallel in relation to the web.

In known processes for such coating the blade is clamped in a blade holder, the blade being bent or curved as seen in a cross section in a plane extending perpendicular to the web and in the direction of its travel. By this bending of the blade there is obtained a spring force acting against the paper web. The most common and easiest way of affecting the blade pressure, i.e. to change the spring force, is to vary the distance between the blade attachment site and the travelling web. In this process the bending of the blade is affected, which also causes a change of the spring force of the blade against the web. The disadvantage of this process is that the parallelism between the edge of the blade and the web as indicated above will be lost, the applied quantity of coating composition being affected in a non-desired way up to the moment when the edge of the blade has been abraded to renewed parallelism with the web.

In order to avoid this inconvenience in the conventional art methods have been developed for the purpose of controlling pressure without changing the angle of engagement of the blade. This has been done by bending the blade in such a manner that the spring force will be changed without significant change of the angle of engagement of the blade against the web. Such a process is described in Swedish patent 8502927-0. The development of paper machines has resulted in processing of web width of up to 8 to 10 m. This development has resulted in great difficulties in connection with the use of presently available techniques, in view of the fact that with such width of the web it is difficult to manufacture a blade holder which will not be deformed, i.e. bent, under the influence of varying forces originating from blade pressure, heat tensions, deflection by inherent weight, etc. Since the doctor blade in the known technique is rigidly clamped in the blade holder the bending or deformation of the latter will affect both the angle of engagement of the blade and the pressure in its engagement against the web in a non-desired manner.

For the purpose of avoiding these problems methods have been developed for the purpose of enabling continuous measurement of the rectilinearity of the blade holder and automatic compensating for deviations from rectilinearity while using hydrolic systems. The disadvantage of such technical solution is the fact that it is technically much too advanced and results in high investment costs and, moreover, it requires extensive maintenance. Techniques are also developed whereby it is possible to point-wise, automatically or manually, exert pressure on the blade in order to compensate for the variations arising at the area of a the blade engagement when the blade holder is deformed. The disadvantage associated with these techniques consists in the fact that by exerting a varying pressure on the blade the parallelism between the surface of engagement of the blade and the web will be affected which has for an effect that these techniques are technically very difficult to apply.

OBJECT OF THE INVENTION

The present invention has for its object to provide an apparatus, by means of which a simple and operationally safe continued control of The applied quantity during the course of the coating will be obtained in a satisfactory manner.

Another object of the present invention is to provide a process by means of which the disadvantages of the prior art are eliminated or at any rate substantially reduced.

SUMMARY OF THE INVENTION

The present invention is based on a totally new concept for controlling the engagement pressure of the blade against the travelling web, and the invention enables control of said pressure of engagement of the blade without changing the parallelism of the edge of the blade toward the web.

For these and other objects that will be clear from the following description the invention provides for an apparatus for blade coating of a travelling web, preferably a paper web, said apparatus comprising conventional means for supporting and feeding of the web and a doctor blade extending across the web and engaging the web along one edge or long-side thereof. The blade has for a function to even out a coating composition applied to the web. The apparatus furthermore comprises a blade holder carrying the blade along its other or opposite long-side. The apparatus according to the invention is characterized by pressure means which are arranged to bring said first long-side of the blade, from the above and adjacent To said long-side of the blade, to engagement on the web without imparting substantial bending to the blade as seen in a cross-section. The apparatus is furthermore characterized by the fact that the blade is movably clamped in the blade holder.

Said pressure means of the apparatus preferably comprise a ledge or list coextensive with the blade which in its cross-direction forms an angle to the blade and which is arranged to exert a pressure along said first long-side of the blade with one of its longitudinally extending edges. It is, moreover, preferred that said pressure means are arranged distributed along the length of the list for individual section-wise control of the pressure against the blade along its said first long-side. Through this preferred embodiment of the device according to the invention the control is suitably carried out automatically by feed-back from sensors distributed across the width of the web, said sensors continuously measuring the applied quantity of coating composition. By such continuous control of the quantity of applied coating composition across the web possible deformation of the blade holder will be compensated, said deformation being due to heat stresses, deflection in view of inherent weight, deflection in view of forces from the blade pressure, etc.

For the purpose of facilitating this section-wise control of the pressure against the blade it is suitable that the list or ledge is provided with laterally extending slits opening at the other longitudinally extending edge of the ledge, said ledge being imparted the necessary flexibility.

The blade holder allowing movable clamping of the blade in accordance with the basic concept of the invention can be designed in two parts with one fixedly anchored lip and a juxtaposed movable lip, the blade being movably clamped between said lips.

In order to prevent the coating composition from penetrating into the interior of the blade holder it is provided that one of said lips is provided with a resilient sealing arranged along the blade holder, said sealing simultaneously allowing movability of the blade.

The apparatus according to the invention is suitably provided with space means located between the two lips, whereby the clamping pressure between the lips can be controlled.

In connection with the site of evening of the coating composition by means of the doctor blade it is suitable to arrange a backing, for example a roll, the surface facing the web of which is elastically resilient. Such resiliency can suitably be provided by an elastic and resilient coating, for example of rubber or similar synthetic material. In this way unecessary web failures can be avoided in view of the fact that bulges, particles in the paper web or the like easily can pass between the web and the doctor blade.

The invention also provides for a process for coating a travelling web while using a doctor blade engaging the web, said doctor blade extending across the web, for example across its entire breadth, and said blade having for its function to even out a coating composition applied to the web through engagement against the web of one longside or edge of the blade. Said process is characterized by the fact that the engagement of the blade is provided by application of forces from the outside along said longside of the blade so that the blade can exert its evening function without substantial bending in its cross-direction.

It is preferred in this process that said forces along the long-side of the blade are controlled section-wise independently of each other for providing even coating across the whole breadth of the web.

The expression used in the present disclosure "adjacent to" with regard to the site of applying the forces from the outside of the doctor blade means that said forces are applied sufficiently close to the blade edge in question in order that the blade shall remain substantially straight and not curved as seen in a cross-section parallel to the direction of the travel of the web.

The invention will in the following be further described in connection with a preferred embodiment, and said description is made with reference to the appended drawings, wherein.

DETAILED DESCRIPTION OF THE INVENTION

Figure 1:
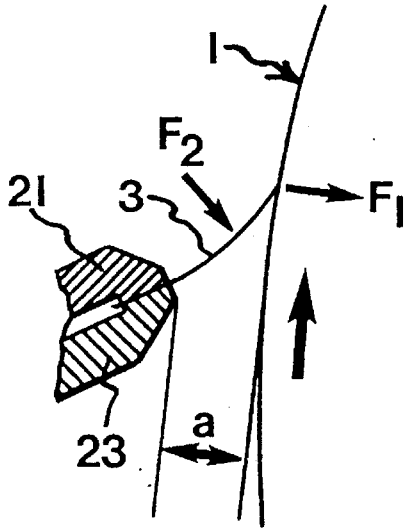
FIG. 1 shows diagrammatically the traditional techniques of obtaining blade engagement against web and backing.

FIG. 1 shows the traditional way of obtaining engagement of the doctor blade against a travelling paper web. In this prior art the blade is deflected by its fixed clamping in a blade holder, and the spring properties of the blade provides the engagement pressure $F_1$ against the web and the backing which is desirable for providing the intended evening out of the coating composition that has been applied to the web. The desired engagement pressure against the paper web will be obtained by adjusting the distance a) between the blade holder and the backing 1 through supplementation with an outer load $F_2$ applied to the doctor blade, whereby the total engagement pressure is the sum of the pressure obtained by the fixed clamping of the blade and the application of the external load.

Figure 2:
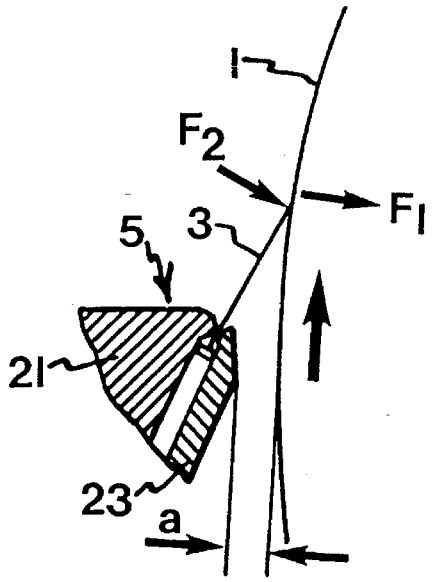
FIG. 2 illustrates diagrammatically the technique according to the present invention for obtaining a corresponding engagement against the web.

FIG. 2 illustrates diagrammatically the technique according to the present invention, where the engagement pressure against the paper web is provided without making use of spring properties of the doctor blade. In this technique the blade holder generally designated 5 is positioned at a constant distance a) to the backing 1. Blade 3 remains essentially straight in view of the movable clamping in the blade holder 5. By forces $F_2$ applied at the free long-side of the blade 3 the desired engagement against the web and the backing will be provided without bending blade 3 and without losing the parallelism vis-a-vis the paper web. Forces $F_2$ are applied for this purpose adjacent to the site of engagement between the free edge of doctor blade 3 and the web and the backing.

Figure 3:
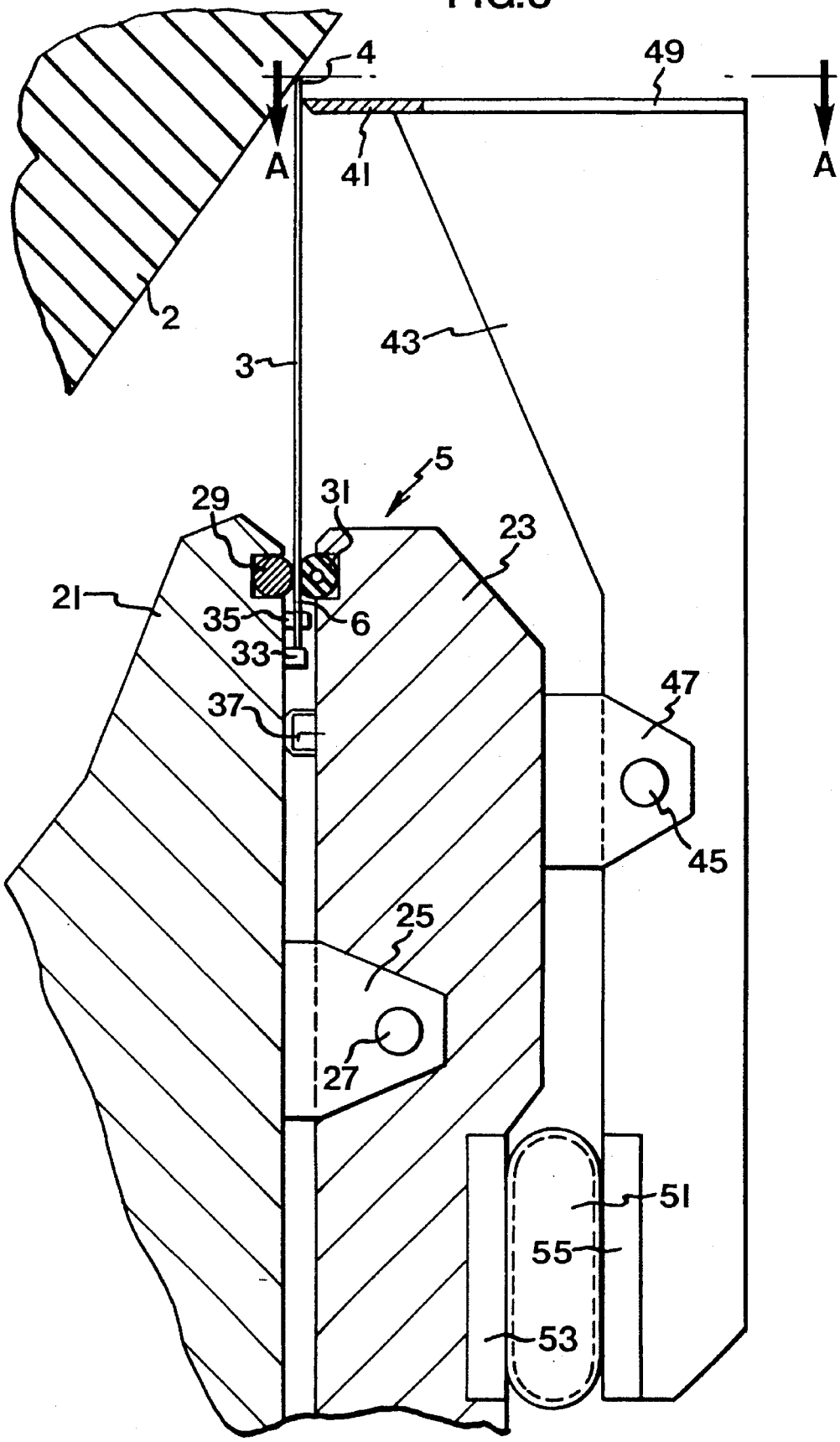
FIG. 3 shows the basic design of the apparatus according to the invention more in detail.
Figure 4:
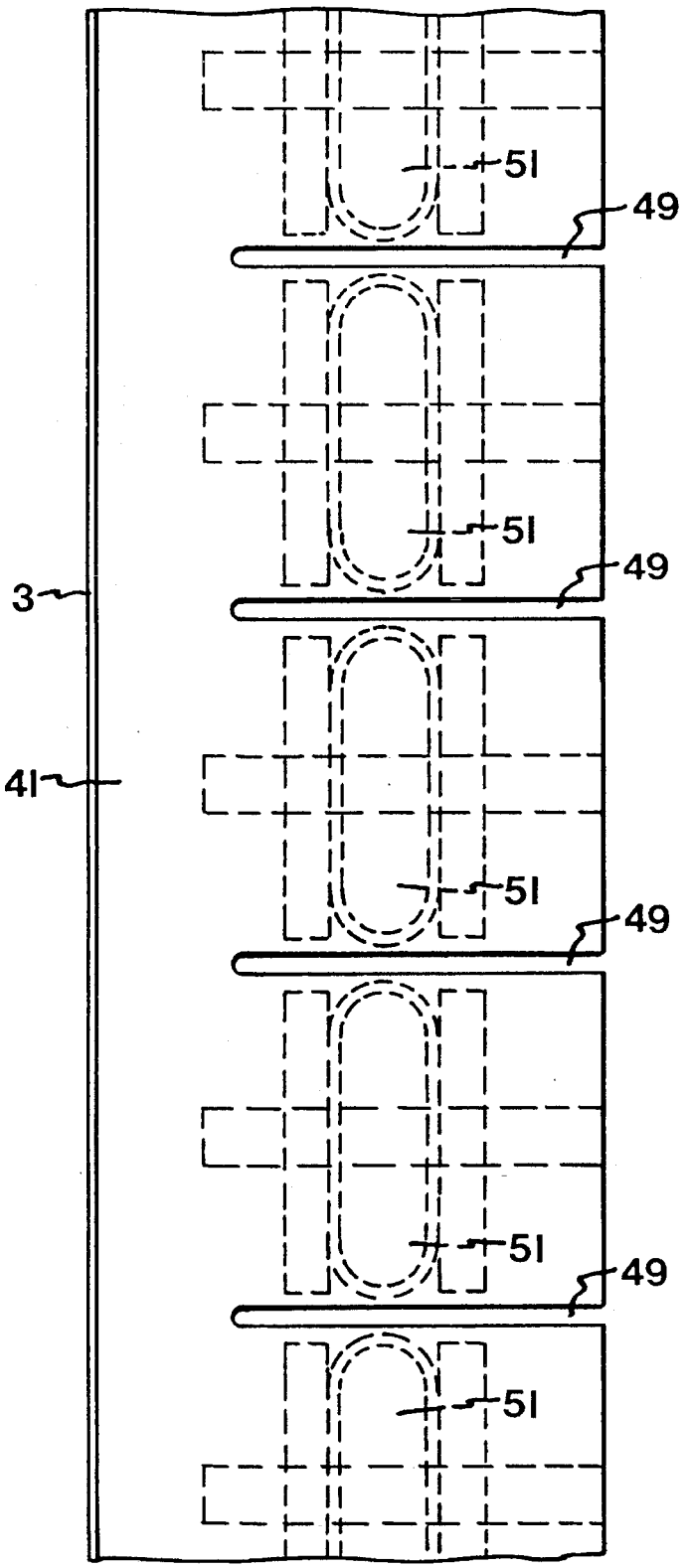
FIG. 4 shows a section A—A of the apparatus of FIG. 3.

FIGS. 3 and 4 show more in detail an exemplifying embodiment of the apparatus according to the invention. At the top and to the left in FIG. 3 there is shown a minor part of the backing in the form of a resilient coating 2 on a roll not shown, said coating being for example constituted by rubber of the suitable hardness. The blade holder proper generally designated 5 includes a fixed lip 21 which is attached to the fixed parts of the coating equipment in a manner not shown, and a juxtaposed movable lip 23. Said movable lip 23 is pivotable around a pin 27 arranged in two side elements 25 placed on each side of the movable lip 23. Both lips 21 and 23 thus extend along the whole width of the web.

The blade holder 5 has for a function to hold a doctor blade 3 with its respective long-sides 4, 6 between the two lips 21, 23 in a movable manner. Also this blade extends across the whole width of the paper web and engages by longside 4 the paper web and the underlying backing 9. In the embodiment shown the upper lip 21 is provided on the interior side thereof with a round bar 29 placed in a corresponding recess, said round bar 29 extending across the whole length of the lip 21. On the opposite side and on the inside of the movable lip 23 a resilient rubber list 31 is provided placed in a corresponding recess, and also said rubber list 31 extends along the whole length of blade holder 5 or lip 23. By this arrangement both sealing against the coating composition and desired movability for doctor blade 3 will be obtained. By the use of stop knobs 33 attached to the edge of blade 3 and positioning pins 35 easy assembly and determination of a location of doctor blade 3 will be enabled. By adjustable spacers 37 the nip pressure between the engagement surfaces of the lips can be controlled.

The necessary external compressive force on the doctor blade 3 adjacent to the engagement of the blade against the web will be provided by a longitudinally extending pressure ledge 41 which is attached to a number of pivot arms 43 distributed across the width of the web. These pivot arms 43 are positioned at such intervals that pressure ledge 41 will not be subjected to substantial deflection in the space between each pivot arm 43. Pressure ledge 41 is provided with slits 49 distributed along its length for the purpose of imparting to the pressure ledge suitable flexibility in connection to varying pressures as determined in association with each pivot arm 43.

Each pivot arm 43 is pivotably arranged on lip 23 around pins 45 attached to side elements 47 placed on each side of each pivot arm 43 and in turn attached to the outer side of lip 23. In connection to each pivot arm 43 there is arranged a pressure member 51 in the form of a bellows acting on the free end of pivot arm 43 via plates 53, 55 attached to the outer surface of lip 23 and to the inner free end of pivot arm 43, respectively. In view of the fact that each pressure member 51 can be controlled individually it is thus possible to control the engagement pressure of blade 3 against the web section-wise along the length of blade 3. In this manner one can ensure uniformity of coating of coating composition on the paper web across the full width thereof and in its longitudinal direction.

Figure 5:
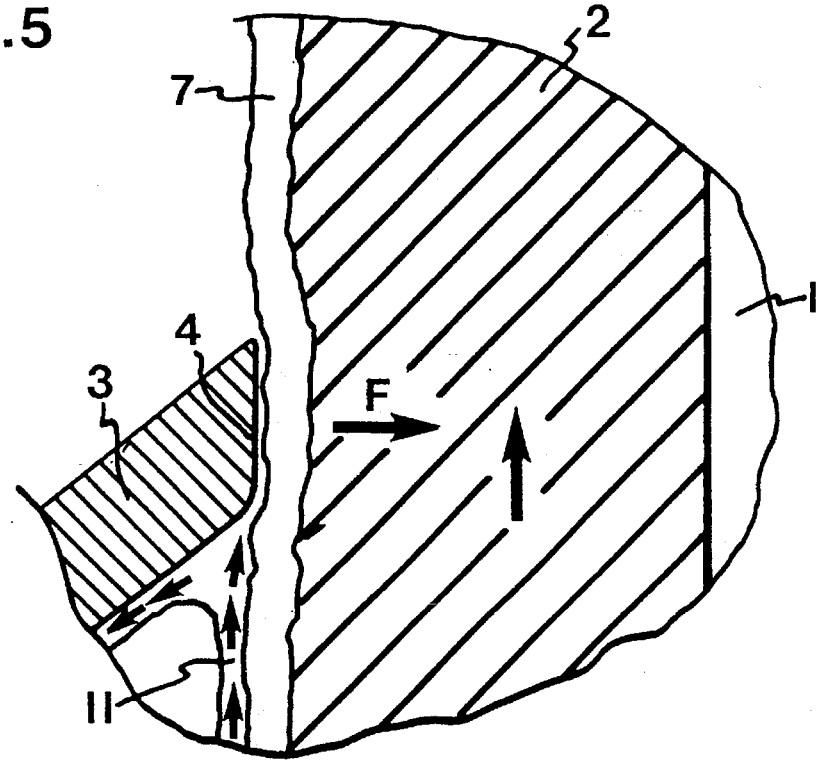
FIG. 5 illustrates a detail on the area around the site of the blade engagement when using a resilient backing.

FIG. 5 shows diagrammatically in an enlarged view the area around the engagement of blade edge 4 on the paper web 7. Thus, when there are irregularities in the coating composition 11 or in the paper web 7 such irregularities can easily pass the area between the engaging edge of the blade and paper web 7 in view of the fact that backing 2, in view of its flexibility, yields to the formation of a depression. The risk for web failure with concomitant operational disturbances will hereby be reduced.

The invention is, of course, not limited to the embodiments shown, since alternative examples of embodiments are conceivable. Thus, the attachment of the doctor blade can be carried out in many ways meeting with the requirement of movability of the doctor blade. Also the technique of exerting an external load on the blade thereby controlling its engagement against the web can be modified. It is only essential that the blade is not subjected to substantial bending or curving under the influence of forces applied exteriorly, whereby the parallelism between the engaging edge of the blade and the web can be maintained. In addition the invention enables section-wise controlling of the engagement pressure across the web and, of course, also possibility of controlled section-wise pressurizing so as to obtain an even coating also in the direction of web travel.

I claim:

1. A process for evening out a coating composition on a travelling web while using a doctor blade engaging the web, comprising the steps of:

providing a doctor blade including a first long-side, a second long-side, an inner side and an outer side, said doctor blade extending at least partially across the web, and a blade holder carrying the blade (3) along the second long-side, said doctor blade being movably clamped in the blade holder so as to allow the blade to move independent of blade holder movement and evening out a coating composition on a travelling web through engagement against the web of the first long-side of the blade, characterized in that the engagement of the blade is provided by an application of forces on the outer side along said first long-side of the blade so that the blade can exert an evening function without sufficient bending in its cross-direction that results in the first long-side of the blade losing parallelism with the web.

2. A process according to claim 1, characterized in that said forces along the long-side of the blade are controlled section-wise independently of each other for providing even coating across the web.

3. The process of claim 1, wherein the blade extends across an entire breadth of the web.

4. The process of claim 1, wherein the movement of the blade independent of blade holder movement is a rocking motion towards and away from the web.

5. An apparatus for blade coating of a travelling web (7), comprising:

means (1, 2) for supporting and feeding of the web;

a doctor blade, said doctor blade comprising a first long-side, a second long-side, an inner side, and an outer side, extending across the web and engaging the web along the first long-side (4) of the blade for evening out a coating composition (11) applied to the web;

a blade holder (5) carrying the blade (3) along the second long-side (6), said blade being movably clamped in the blade holder so as to allow the blade to move independent of blade holder movement; and pressure means (41, 43, 51) for applying pressure on the outer side and adjacent to said first long-side so as to bring said first long-side of the blade to engagement of the web (7) without imparting substantial bending to the blade thereby maintaining parallelism between said first long-side of the blade and the web.

6. An apparatus according to claim 5, characterized in that said pressure means comprise a ledge (41) coextensive with the blade which in its cross-direction forms an angle to the blade (3) and which is arranged to exert with a first longitudinally extending edge thereof, a pressure against the blade along said first long-side of the blade (3).

7. An apparatus according to claim 6, characterized in that said pressure means (43, 51) are arranged along a length of the ledge (41) for individual section-wise control of the pressure against the blade (3) along said first long-side of the blade (4).

8. An apparatus according to claim 7, characterized in that said ledge (41) is provided with laterally extending slots (49) opening at a second longitudinally extending edge (6) of the ledge for the purpose of imparting flexibility to the ledge in connection with said individual pressure control.

9. An apparatus according claim 5, characterized in that the blade holder includes a fixedly anchored lip (21) and a juxtaposed movable lip (23), the blade (3) being movably clamped between said lips (21,23) so as to allow the blade to move independent of blade holder movement.

10. An apparatus according to claim 9, characterized in that at least one of said lips is provided with a resilient sealing lip, whereby there is obtained both sealing against the coating composition and the movability of the blade (3) independent of blade holder movement.

11. An apparatus according to claim 10, characterized in that space members (37) are arranged between the two lips (21, 23), whereby a clamping pressure between the lips can be controlled.

12. An apparatus according to claim 9, characterized in that at least one of said lips is provided, on an interior side thereof, a round bar (29) placed in a corresponding recess, thereby obtaining the movability of the blade independent of blade holder movement.

13. An apparatus according to claim 5, characterized in that said means for supporting and feeding of the web (7) comprise a backing (1, 2) arranged in connection with an area of evening out the coating composition (11) by means of the doctor blade (3), the surface of said backing facing the web being elastically resilient.

14. The apparatus of claim 13 wherein the backing is a roll.

15. An apparatus according to claim 13, characterized in that said backing (1) is provided with a resilient coating (2).

16. The apparatus of claim 15 wherein the resilient coating is comprised of rubber.

17. The apparatus of claim 5 wherein the travelling web is a paper web.

18. The apparatus of claim 5, claim 9, claim 10 or claim 12, wherein the movement of the blade independent of blade holder movement is a rocking motion towards and away from the web.

* * * * *